US005179850A

United States Patent [19]

Capdevila Mas

[11] Patent Number: 5,179,850

[45] Date of Patent: Jan. 19, 1993

[54] MAGNETIC LATCHKEY

[76] Inventor: Juan Capdevila Mas, Ctra. de Torello s/n., 08572 Sant Pere De Torello, Barcelona, Spain

[21] Appl. No.: 604,937

[22] Filed: Oct. 29, 1990

[30] Foreign Application Priority Data

Oct. 30, 1989 [ES] Spain ..... 8903937
Jul. 20, 1990 [ES] Spain ..... 9001971

[51] Int. Cl.[5] ..... E05B 47/00
[52] U.S. Cl. ..... 70/276; 70/413
[58] Field of Search ..... 70/276, 413, 277, 278

[56] References Cited

U.S. PATENT DOCUMENTS 4,712,398 12/1987 Clarkson ..... 70/276
4,849,749 7/1989 Fukamachi ..... 70/413
4,932,228 6/1990 Eisermann ..... 70/276
4,936,896 6/1990 Takatsuka ..... 70/432

FOREIGN PATENT DOCUMENTS 8802942 9/1988 Spain .
8900650 2/1989 Spain .

*Primary Examiner*—Renee S. Luebke
*Assistant Examiner*—Suzanne L. Dino
*Attorney, Agent, or Firm*—McGlew & Tuttle

[57] ABSTRACT

A magnetic latchkey for an access-control lock with a series of magnets fastened to sliding pieces capable of being displaced by means of levers or extensions so that each magnet has three possible positions: north pole, south pole, or a point intermediate to both. This allows the magnet to be moved in front of the appropriate sensor of the lock, in such a way that when there is a particular combination of poles in the latchkey and the same combination of switches on the control panel, in touch with the position of the switches at the control panel will be identical to the positions of the levers of the latchkey. An alternative is for each magnet of the latchkey to have two sensors inside the lock.

16 Claims, 5 Drawing Sheets

FIG. 1a
FIG. 1b
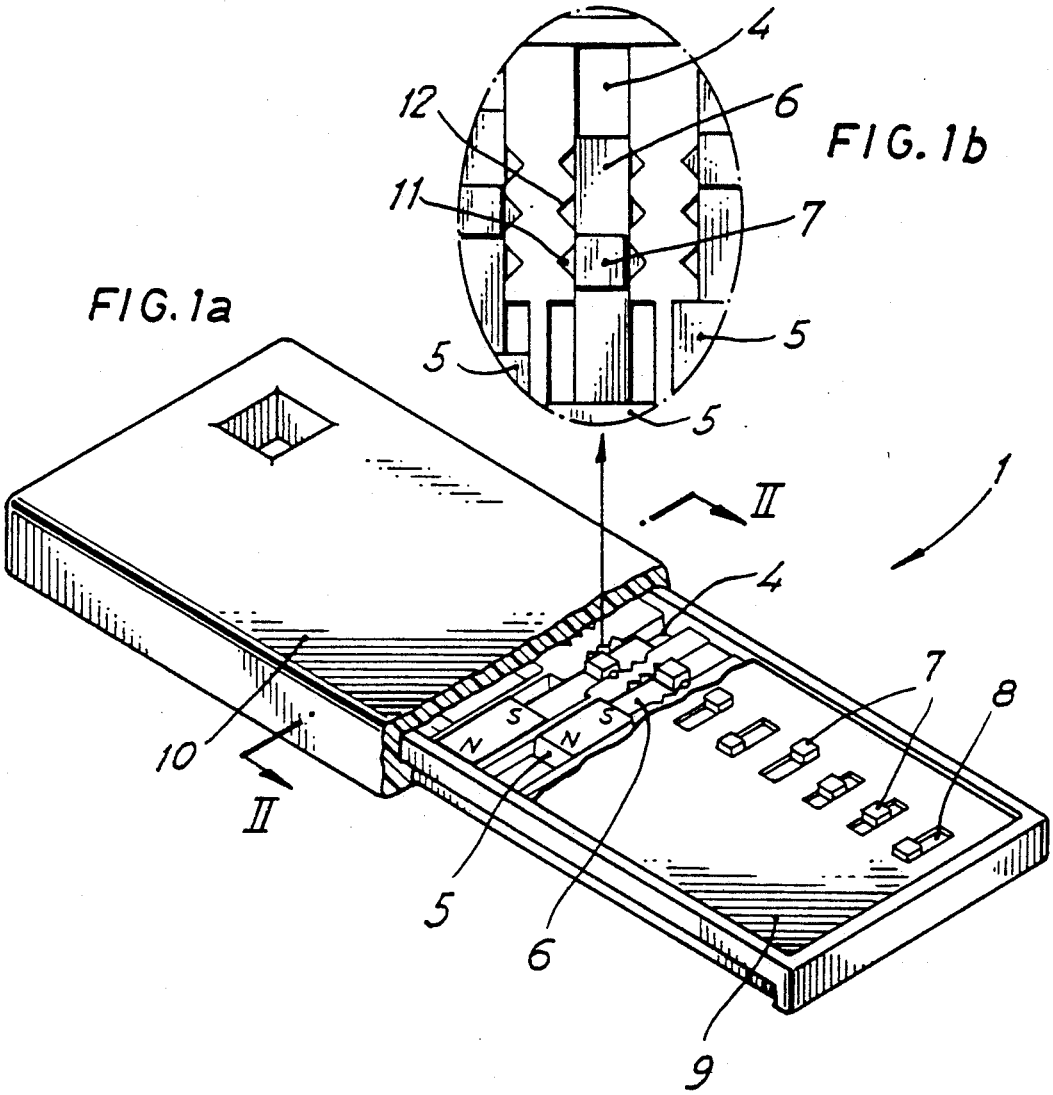
FIG. 2
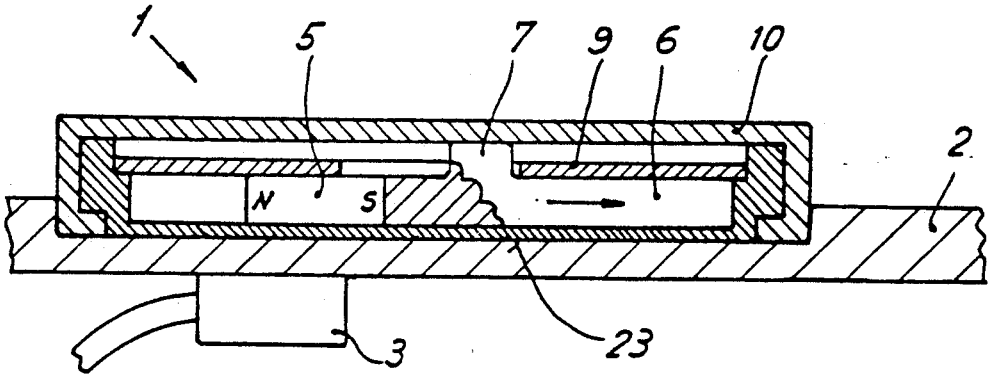

MAGNETIC LATCHKEY

FIELD OF THE INVENTION

The present invention relates to some improvements in the latchkeys of access-controlling locks, such as doors for garages, shops, offices, etc., and substantially complementing said latchkeys with a lock that consists of a remote control device and a receiving control panel. When the latchkey is introduced or applied to the lock, the latter sends a coded signal via radio or cable to the electronic control panel, which decodes the signal it receives; if this code coincides with the code that has been preset in the panel, then the panel will activate or deactivate the access sequence.

DESCRIPTION OF THE PRIOR ART

Spanish Patent no. 8802942 discloses a latchkey and the corresponding magnetic lock, which consists of a body or bit which is provided with one or more rows of holes that can be filled with magnetized stop-start disks that present a north or south pole to one or the other face of the bit, or the holes may remain empty to form a three-way combination, the bit being covered with a cover that can slide longitudinally along the bit so as to cover or uncover it, and provided with means of fixing the position of the bit in relation to the cover. The lock consists of a grooved case and an interior passageway into which the latchkey is to be introduced, the sides of this passageway being provided with a series of paired magnetic sensors of the same geometric placement and equal in number to the fillable holes of the latchkey, these magnetic sensors being connected to a coding circuit.

Such locks usually include a circuit that encodes the digital ternary electrical signals that are sent to the electronic control panel as mentioned above.

On the other hand, Supplemental Certificate no. 8900650 and Spanish patent no. 8802942 modify the latchkey described above, such that the latchkey cover contains holes with or without magnets. In the above-mentioned Supplemental Certificate there is also a simplification of the lock itself by providing it with magnetic sensors, each of which can recognize by itself that it is facing the north or south pole of a magnet, or the absence of such, dispensing with the sensor-pairs previously utilized. This replaces the groove of the lock with an exterior inclined plane; consequently, instead of introducing the latchkey into the lock in such a way as to come between the pairs of sensors, it is actually applied over the inclined plane of the lock, below which there is a single series of sensors.

Returning to the electronic panel, it is necessary to recall the known fact that these panels have a series of switches that can be accessed by the employee on duty, each of which presents three positions: positive, negative and high impedance (i e., no current). When one or another position has been preset in all switches, the control panel code is preset. The latchkey must of course have the same code as that by which the control panel responds to the signal sent from the lock.

So then, while the user himself may change the magnetic combination of the latchkey as needed, there is no easy way to align the presence (or absence) of latchkey magnets with the position of the control panel switches, which must of course be reset in order for the two codes to agree.

BRIEF SUMMARY OF THE INVENTION

By way of resolving these difficulties, the present invention relates to a latchkey that also contains the series of magnets to which reference has been made, these being placed in pairs or in the form of an elongated rod; each pair or rod is attached to a sliding piece and has an extension resembling a switch on the control panel. Each sliding piece may occupy three positions: the respective magnet (or magnets) will appear at an appropriate position in the latchkey: front or north end, south end, and another with no definite polarity, corresponding respectively to a high-impedance, negative or positive signal which each sensor in the lock can identify.

Thus when the combination of the latchkeys (and of the control panel) needs to be changed for any reason, the user only has to take his latchkey and, standing in front of the electronic control panel, change both so that switches or extensions are in the same position, without needing to be concerned with reversing the magnets, subtracting some and adding others, which could lead to mistakes in coordinating the new combination with the control panel.

As an alternative to the above-mentioned extensions, there are other elements that could activate the sliding pieces with their magnets, to be described below, but just as easy for the user to operate.

On the other hand, to avoid the problem of instability at the midpoint, given the fact that the sensor tends to move toward one or the other of the two poles rather than taking a neutral position, as would be appropriate for locating the lever or extension at this midpoint, the invention proposes having a single magnet at each conjuncture and moving this between the two sensors by means of which the control panel is to receive the command of one sensor (right position) or the other (left position) or a signal from both or neither of the sensors (middle position).

To facilitate the explanation of this, the present description includes some drawings that show a practical embodiment, which is given only as an example and does not delimit the subject of this patent.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1*a* is a perspective view of the latchkey partially opened.

FIG. 1*b* is an enlarged detail of the FIG. 1*a*.

FIG. 2 is a cross-sectional view of the latchkey taken along the line II—III of the FIG. 1*a*.

DETAILED DESCRIPTION OF THE PREFERRED EMBODIMENTS

Figure 3:
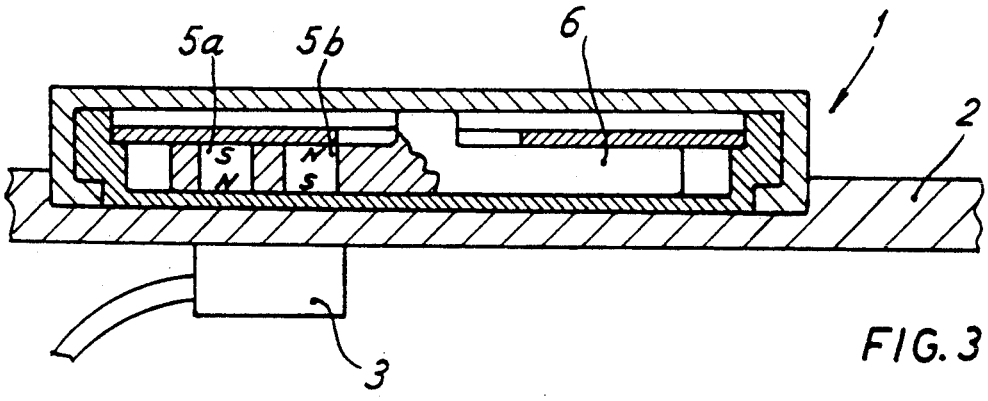
FIGS. 3–5 are cross-sectional view of the single magnet latchkey for each of the various types and in different positions, facing a sensor of the magnetic lock.

Referring to the drawings in particular, improvements in the magnetic latchkeys of the controlled access locks, which is the subject of the invention, comprises providing a latchkey body 1 with some internal slots or lodgings 4 in which each set of magnetic poles can slide.

It will be seen from FIGS. 1*a*, 1*b* that these sets of poles consist of rod-type magnets 5 with a north and a south end. These magnets 5 are enclosed in sliding pieces 6 that can be manipulated by means of a corresponding extensions 7 that project through wide apertures 8 of a plug 9.

FIG. 2 shows an internal cover, already mentioned, an outer auxiliary cover 10, the sliding piece 6 and the magnet 5, and one can see clearly that the magnet 5 is displaced by the extension 7 in such a way that its north pole confronts the sensor 3 of the lock 2 when the user applies his latchkey 1 to the latter.

Returning to FIGS. 1*a*, 1*b* each sliding piece 6, and ultimately its magnet 5, can occupy three positions: top, middle or bottom, positions that are established by a cog 11 that projects from the slide piece 6 in question, which becomes lodged in one or another of the grooves 12 of their respective lodging 4.

FIG. 3 shows another section of the latchkey body 1, the only difference is that the magnet 5 has been replaced by two small magnets 5*a*, 5*b* separate and opposite in polarity; the piece 6 has been slid over so that none of the north or south poles contacts the sensor 3. This corresponds to a positive signal.

Figure 4:
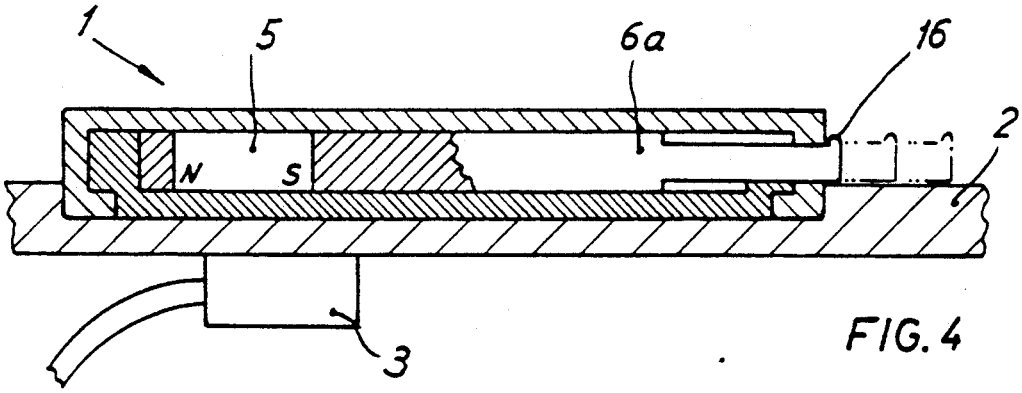

In the cross-section of FIG. 4 the sliding piece 6*a* has been displaced so that the south pole confronts the sensor 3 of the lock 2. The magnet 5 consists of the rod already described, but in this case the sliding piece 6*a* lacks an extension; instead the sliding piece projects outward at an edge of the latchkey body 1 and has a thin outer flange 16 that facilitates drawing the above-mentioned piece 6*a*, which is also free to take one of the three basic positions (designated in the drawing by broken lines).

Figure 5:
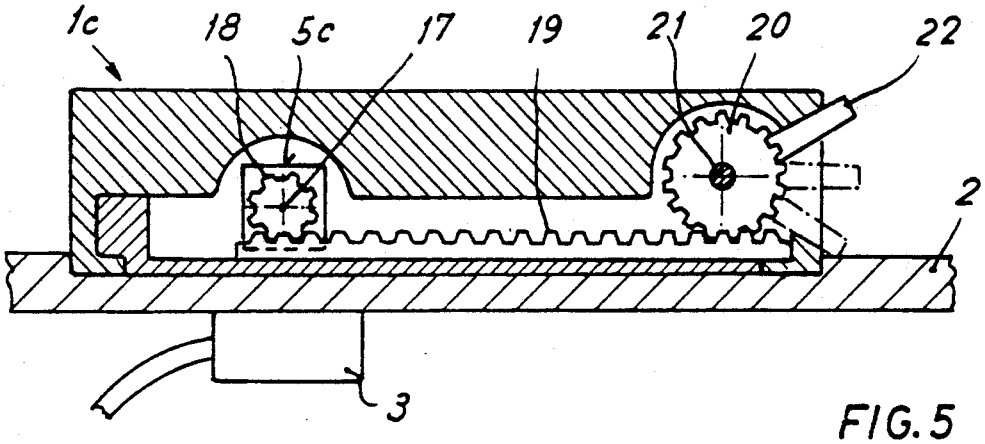

FIG. 5 shows an alternative in which each magnet consists of a rotating cube 5*c* strung on an axis 17 in common with the other magnets of the latchkey 1*c*. Integral with this magnet 5*c* is a pinion 18 that meshes with a rack 19. On the other side of the latchkey body 1 is a rack 20 which also meshes with the cogwheel 19 and rotates around the axis 21 in common with other homologous wheels of the latchkey; it is also provided with a lever 22 that protrudes to the exterior.

When there is an appropriate relationship of the diameters and cogs between the pinion 18 and the wheel 20, then by depressing the lever 22 (for example, by 30 ), the rack 19 moves and the pinion 18 rotates by 90°, or, in other words, a quarter turn. If the magnet 5*c* previously presented it a north pole to the sensor 3, the rotation will cause it to present a face intermediate to its north and south poles; if the lever 22 is turned another 30°, then the pinion 18 will make another quarter turn and the magnet 5*c* will present its south pole.

It is clear also that the user will easily identify these positions of the lever 22—top, middle and bottom—as being extensions 7 of the switches 14 of the control panel 13.

Figure 6:
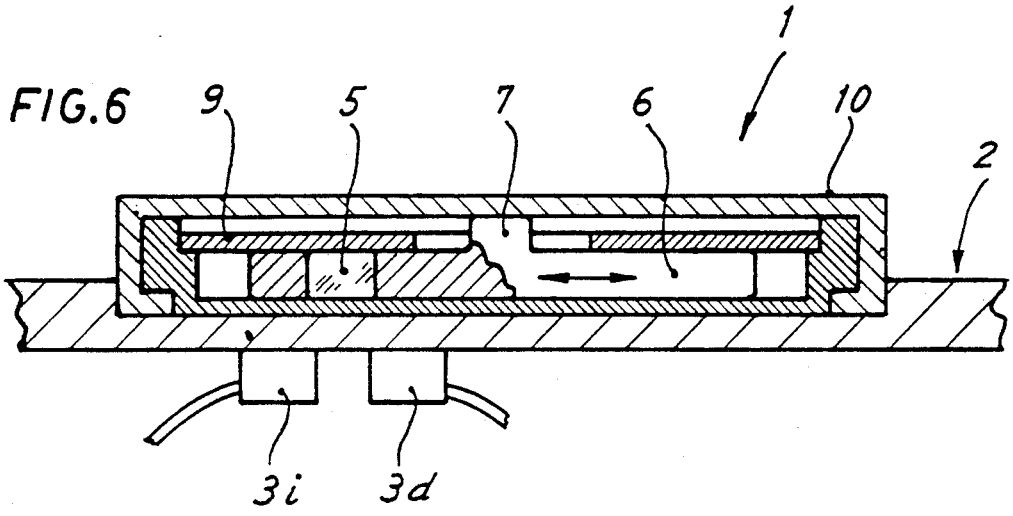
FIGS. 6 and 7 are cross-sectional views of the latchkey with a set consisting of one magnet and two sensors.

Another preferred embodiment (FIG. 6) makes use of a single magnet 5 for each set, and two sensors 3*i*, 3*d*. The magnet 5 is positioned so that its poles are free, i.e., with its north pole at the top and the south pole at the bottom, or vice versa. The two sensors 3*i*, 3*d* will be of the type that records a magnetic field rather than a particular pole.

To displace the magnet 5 to the right and place the latchkey body 1 on the lock 2, the sensor 3*d* announces its magnetic field by sending a signal to the control panel that identifies this movement to the right (a purely arbitrary designation in referring to the drawing); when it is displaced to the left, the sensor 3*i* announces the magnetic field of the magnet 5 and the control panel "recognizes" this signal as coming from the left; if the magnet 5 is placed in the middle position, which is what the drawing depicts, then either both sensors of the lock 2 or neither of them will receive the magnetic field, and the control panel will interrantly translate this as the middle position.

Figure 7:
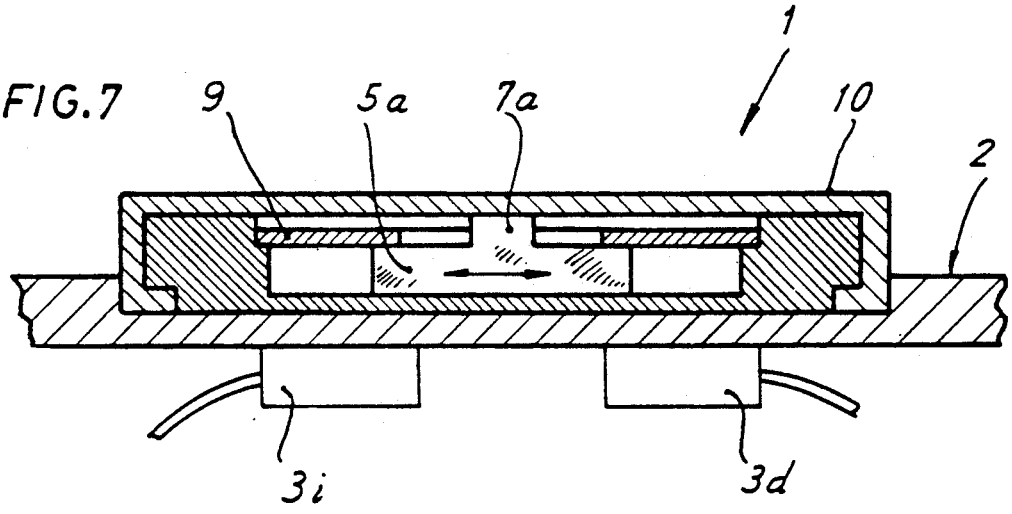

It is advantageous for the sliding piece 6 to be replaced with its own magnet 5*a* (FIG. 7), which has the appropriate dimensions and which is also provided with the extension 7*a* for purposes of manipulation. The sliding piece 6 is accordingly eliminated.

Figure 8:
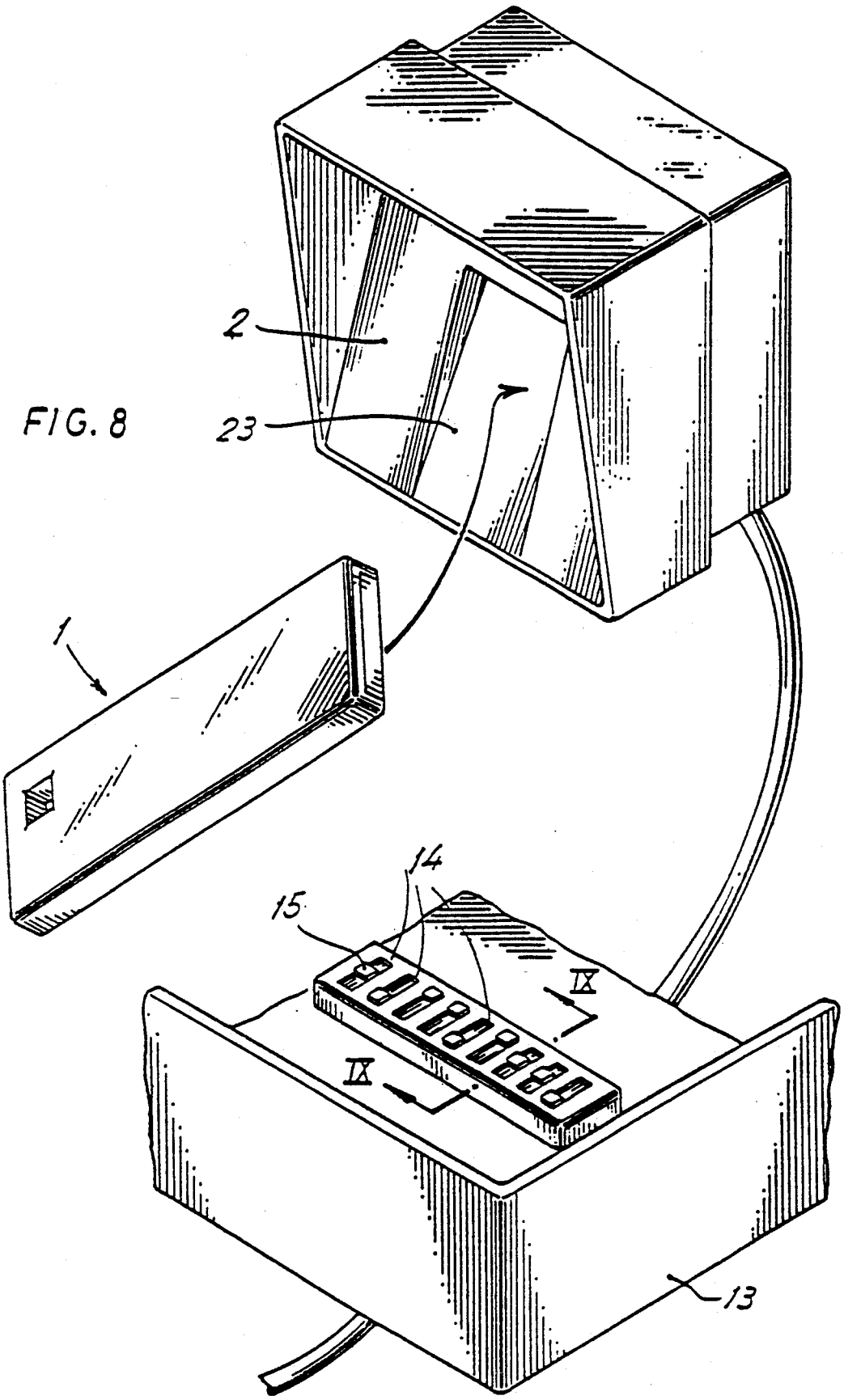
FIG. 8 shows an assembly in perspective view of the latchkey, which is the subject of the present invention, and including a known lock and a known control panel.

The functions of said three positions is that when the latchkey body 1 is place upon the slanted recess 23 of the lock 2 the magnets 5 will present either a north, south or intermediate position to the respective sensors 3 of the lock 2. Such sensors 3 will make their own signal according to those positions of magnets, and form a certain key combination. The total assembly of signals will be sent to the control panel 13 (FIG. 8). There it is decoded and compared with a predetermined control panel combination of switches 14 in the control panel 13. In order for the panel to "answer" and command the performance required for access, entrances, etc., the control panel 13 and the magnets in the latchkey body 1 must conform to the same combination.

Figure 9:
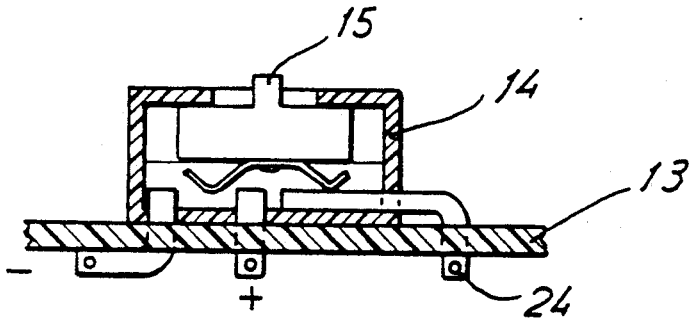
FIG. 9 is a cross-sectional view of the decoder of a control panel taken along the line IX—IX of the FIG. 8.

With the improvements that relate to the present invention it is quite easy to coordinate an identical combination for the magnets in the latchkey body and the control panel 13. The known control panels used for these purposes contain a decoder which has a block of electronic switches 14 that are manipulated by the relevant extensions or pivots 15 which cause contact of connecting terminal 24 wither to +, −, or nothing which is the case shown in FIG. 9.

This is the very aspect presented by the magnetic latchkey 1 in accordance with the present improvements (FIG. 1). All that will then be necessary will be that the extensions 7 of the latchkey and pivots 15 of the control panel 13 to have the same position.

When the combination needs to be changed, the user will not need, as previously required, to check on the agreement of the magnetic poles in his latchkey with the instructions written on the panel.

While specific embodiments of the invention have been shown and described in detail to illustrate the application of the principles of the invention, it will be understood that the invention may be embodied otherwise without departing from such principles.

What is claimed is:

1. A magnetic latch arrangement comprising:

a latchkey body; and a plurality of magnets movably contained in said latchkey body and each of said plurality of magnets movable into a plurality of positions with respect to said latchkey body, a lock having a recess means for receiving said latchkey body.

2. A magnetic latch arrangement according to claim 1, wherein: said one magnet is in a form of a rod with one pole at each end.

3. A magnetic latch arrangement according to claim 1, wherein: said one magnet consists of two subset magnets with each subset magnet being adjacent the other subset magnet and with opposite poles.

4. A magnetic latch arrangement according to claim 1, wherein said one magnet is a magnetic cube.

5. A magnetic latch arrangement according to claim 1, wherein one magnet of said plurality of magnets includes a sliding piece and an extension.

6. A magnetic latch arrangement in accordance with claim 1, further comprising:

an outer auxiliary cover surrounding said latchkey body.

7. A magnetic latch arrangement in accordance with claim 1, wherein:

said plurality of magnets in said plurality of positions forms a predetermined combination.

8. A magnetic latch arrangement in accordance with claim 3, wherein:

each magnet is prismatic.

9. A magnetic latch arrangement in accordance with claim 1, wherein:

said latchkey body defines an internal slot;

a sliding piece attached to one magnet of said plurality of magnets, said sliding piece slides in said internal slot; and extension means attached to said sliding piece for moving said sliding piece and said one magnet into said plurality of positions.

10. A magnetic latch arrangement in accordance with claim 9, wherein:

said sliding piece has a cog; and said internal slot has a plurality of groove means for receiving said cog and holding said sliding piece and said one magnet in one of said plurality of positions.

11. A magnetic latch arrangement according to claim 9, wherein said latchkey body has an internal cover and said extension projects through a wide side of said internal cover.

12. A magnetic latch arrangement according to claim 9, wherein said extension projects through an opening at an edge of said latchkey body.

13. A magnetic latch arrangement according to claim 9, wherein said sliding piece is a rack that meshes with a pinion, said one magnet being in the form of a magnetic cube, said pinion forming an integral part of said magnetic cube, and said rack including a lever which projects outside of the latchkey body.

14. A magnetic latch arrangement comprising:

a latchkey body;

a magnet movably contained in said latchkey body and movable in to a plurality of positions with respect to said latchkey body;

a lock having a recess means for receiving said latchkey body, said recess means being on a substantially flat planar outside surface of said lock, said lock having sensing means for sensing said position of said magnet; and a control panel means connected to said lock for receiving a key combination from said sensing means said key combination representing said position of said magnet, said control panel means also having a switch generating a control panel combination and said control panel means comparing said key combination with said control panel combination.

15. A magnetic latchkey arrangement in accordance with claim 14, wherein:

said key combination matches said control panel combination when said switch and said magnet are in substantially identical positions.

16. A magnetic latch arrangement comprising:

a latchkey body;

a magnet movably contained in said latchkey body; and mechanical movement means for moving said magnet into a plurality of positions with respect to said latchkey body, a lock having a recess means for receiving said latchkey body.

* * * * *